United States Patent [19]

Bekaert

[11] Patent Number: 4,572,857

[45] Date of Patent: Feb. 25, 1986

[54] INSULATING BOARD OF COMPOSITE MATERIAL

[75] Inventor: Marc Bekaert, Moorslede, Belgium

[73] Assignee: N.V. Maatschappij Voor Studie, Bijstand en Onderzoek "M.S.B.O.", Moorslede, Belgium

[21] Appl. No.: 698,718

[22] Filed: Feb. 6, 1985

[30] Foreign Application Priority Data

Feb. 15, 1984 [BE] Belgium ..... 212390

[51] Int. Cl.[4] ..... B32B 3/12; B32B 7/04; B32B 19/00

[52] U.S. Cl. ..... 428/117; 52/309.11; 428/309.9; 428/313.7; 428/319.1

[58] Field of Search ..... 428/110, 114, 117, 119, 428/120, 167, 247, 294, 312.6, 313.7, 318.4, 319.1, 304.4, 309.9; 52/309.4, 309.7, 309.8, 309.9, 309.11, 309.13

[56] References Cited

U.S. PATENT DOCUMENTS 3,510,391 5/1970 Bolster et al. ..... 428/319.1
3,555,131 1/1971 Weismann ..... 428/319.1

*Primary Examiner*—William J. Van Balen
*Attorney, Agent, or Firm*—Sughrue, Mion, Zinn, Macpeak and Seas

[57] ABSTRACT

A self-supporting board enjoying very good heat insulation and fire-resistant properties is obtained by combining a reinforced plastics foam 2 with insulating boards 3, 4 of expanded perlite. The foam is reinforced by a framework 5 consisting of latticed beams 11 covered by metal meshes 8, 10.

4 Claims, 2 Drawing Figures

INSULATING BOARD OF COMPOSITE MATERIAL

BACKGROUND OF THE INVENTION

This invention relates to an insulating board of composite material designed to be used as a structural member in the construction industry, and comprising a rigid plastics foam core having particularly low thermal conductivity, reinforced by a metal framework and covered on at least one of its faces by a perlite board.

The invention is used in the construction of industrial buildings, commercial buildings, new apartments or private houses, and in renovation work.

DESCRIPTION OF THE PRIOR ART

A composite board comprising a core consisting of a layer of plastics material, covered on at least one of its faces by an expande perlite-based insulating board is known from U.S. Pat. No. 3,510,391.

The use of similar boards is an integral part of conventional techniques for the construction and insulation of flat and/or inclined roofs.

According to one known technique, a support structure is added in a first phase. This support structure may comprise a support frame consisting of a series of small metallic beams, concrete beams or wood beams onto which self-supporting profiled steel plates, for example, are fixed.

Insulating boards, advantageously the aforementioned composite boards, are then placed onto this support structure in a second stage.

These boards are light and have excellent fire-resistant properties, so that they are capable of receiving a flexible layer of roofing which is applied directly using hot bitumen or an intense flame.

However, these boards do not permit the support structure and the insulating properties to be produced in a single stage.

A self-supporting insulating element for roofs and walls, comprising a profiled perforated plate embedded in a core of rigid polyurethane foam insulating material enclosed between two covering boards is also known from French Pat. No. 2,052, 979 (Sullhofer).

The production of such an insulating element is effected continuously and demands the use of a complex apparatus as the perforated plate is unrolled from a coil mounted on a groover, is then profiled by a rolling device and subsequently enters an extruder in the form of a profiled strip.

SUMMARY OF THE INVENTION

An object of this invention is to overcome the aforementioned disadvantage. This invention provides an extremely light composite insulating board which meets the most stringent demands relating to heat-resistance.

This invention relates to an insulating board of composite material designed to be used as a structural member in the construction industry, and comprising a rigid plastics foam core having particularly low thermal conductivity, reinforced by a metal framework and covered on at least one of its faces by a perlite board, essentially characterised in that the aforementioned framework comprises a lower reinforecment and an upper reinforcement consisting of a series of parallel steel rods which are distributed at regular intervals over the entire width of the board, while ensuring that the rods of different series are connected to each other by cross-members and that the rods of the same series are connected to each other by reinforcing meshes.

According to an embodiment of this invention, the edges of the board are provided with a tenon and mortise joint.

Further characteristics and details about this invention will emerge from the following detailed description.

DETAILED DESCRIPTION OF THE INVENTION

Figure 1:
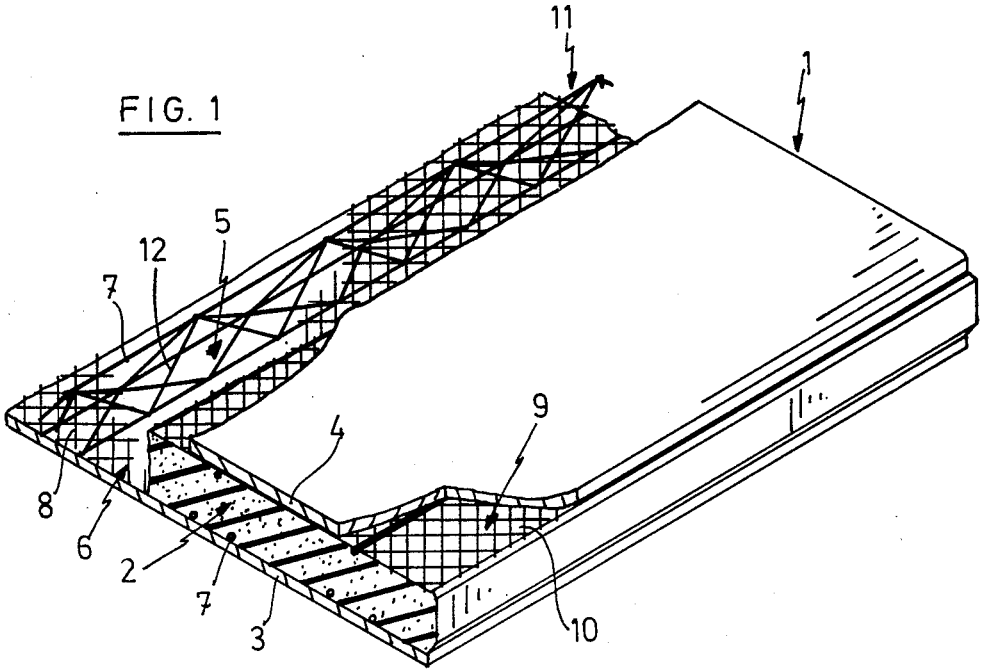
FIG. 1 is a partially exploded perspective view showing an insulating board according to the invention.

The same reference numerals designate identical or analogous elements in the Figures.

Figure 2:
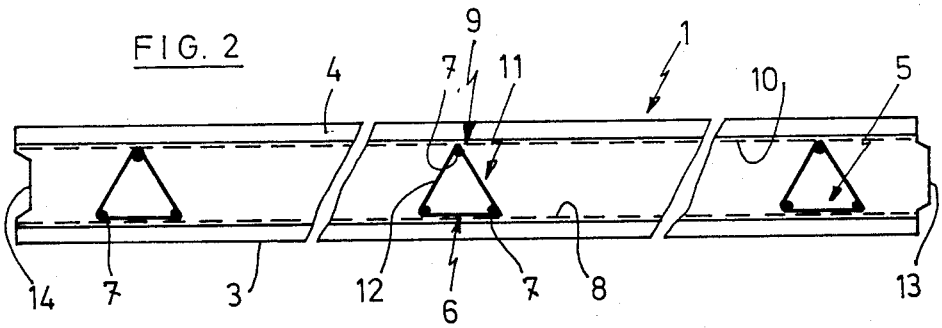
FIG. 2 is a lateral cross-section of the board shown in FIG. 1.

As shown in FIGS. 1 and 2, a composite insulating board according to the invention consists entirely of insulating material. The board is designated as a whole by reference numeral 1 and comprises a reinforced core 2 of plastics foam, provided on each side with a rigid insulating board 3,4 based on expanded perlite.

Perlite is a vulcanic rock which is firstly ground and then expanded at a temperature of about 900° C. until it is about twenty times its original volume. Perlite is non-flammable. It has very good dimensional stability and, in a planar form, has good pressure resistance and good localized hardness. The structure does not alter during the course of time.

The expanded perlite-based insulation consists of at least 5% of expanded perlite, organic and/or inorganic fibres and organic and/or inorganic binders. The grains of expanded perlite are preferably mixed with cellulose fibres and a binder. The components can be mixed in an aqueous medium and poured to the desired thickness on a perforated screen which is moved at a constant speed. Most of the moisture is removed by pressing to the desired thickness and suction under vacuum through the screen. The board is then completely dried in a furnace.

The large perlite content provides for good heat insulation and excellent flame-retarding properties.

Synthetic foam has a low specific weight and good heat resistance. This is particularly the case for a polyurethane foam.

Rigid plastics foam structural board have many uses. Nevertheless synthetic foam boards suffer from particular disadvantages when used in the construction industry, particularly relating to their behaviour under fire, constancy of heat, dimensional stability and technical characteristics.

The combination of a plastics foam core covered by at least one expanded perlite-based insulating board enjoys the advantages of both the plastics foam and the perlite and minimizes the disadvantages of each of these two products.

A framework 5 in the plastics foam core is preferred for increasing the bearing capacity of the insulating board.

The framework 5, which is designed to provide the structural board with greater resistance, can consist of a metal or plastics reinforcement.

In a particular embodiment of the invention, the framework comprises two parts:

1. a lower reinforcement 6 consisting of a series of parallel longitudinal steel or plastics rods 7, placed on a metallic reinforcing mesh 8 of steel, and connected to each other;

2. an upper reinforcement 9, likewise consisting of a series of parallel longitunal rods 7 of steel or synthetic material and a mesh 10.

The two reinforcements can be combined in a prefabricated latticed beam 11 which is mounted between two metallic meshes 8 and 10.

The reinforcement is constructed in such a manner that the stretching and bending stresses are completely absorbed by the steel, while the pressure is only partially absorbed by the steel.

The board is produced by forming a sealed cavity with two perlite boards 3,4 which are maintained at a spacing from each other.

A metallic mesh 8 and various latticed beams 11 are then placed on the lower board 3. These latticed beams 11 consist of longitudinal rods 7 which are connected to each other by cross-members 12.

These latticed beams 11 are placed parallel to each other at regular spacings. A second metallic mesh 10 is placed over this onto which the second insulating board 4 is placed. The lateral walls are then mounted to form a sealed cavity.

A layer of rigid polyurethane foam or of another organic foam is formed directly between the two parallel perlite boards 3,4 with a thickness of from 15 to 20 mm, for example.

The use of a non-metallic framework in the foam provides the element with greater heat-resistance, with the additional advantage of a reduction in weight.

If the insulating element is required to have exceptional bearing capacity, it is recommended that the constituent materials have good mechanical rigidity. This is achieved using high-density perlite boards, for example greater than 175 kg/m$^3$.

The plastics foam is, for example, a rigid polyurethane-based foam. It has, for example, a density of greater than 35 kg/m$^3$ and is of the direct foaming type.

The type of framework can be modified according to the demands made. The framework provides the greatest mechanical strength when it consists of metal and for example, of latticed beams at a short spacing from each other. The framework is preferably treated to protect it from corrosion.

The use of an expanded perlite-based material for the insulation board provides for very good heat-insulation properties and the exertion of exceptional overloads, through the greater density and the construction of a more solid framework.

In all the aforementioned cases, the production speed can be increased, inter alia, by placing a first covering panel onto the perlite board and thereunder a vapour-protecting screen consisting of, for example, an aluminium film.

The low weight in conjunction with good possibilities for prefabrication means that it can be installed quickly and cheaply.

The combination of expanded perlite-based boards and reinforced plastics foam provides the self-supporting element with exceptional thermal properties and mechanical strength.

The edges of the boards can be provided with a tenon and mortise joint 13, 14 so as to permit a perfectly tight installation.

In humid environments, this tenon and mortise joint can be even better sealed by a tight adhesive strip, optionally of aluminium, so the diffusion of vapor along the joints is checked.

The dimentional stability of the perlite board allows the conventional tight system to adhere directly to slightly oblique planar roofs.

The upper face of the board is optionally provided with a bituminous layer which ensures the good adhesion of the first covering layer of the roof.

I claim:

1. A composite roof construction panel board (1), comprising:

(a) a planar sheet of perlite-based material (3), (b) a three-dimensional framework (5) disposed atop the perlite-based sheet and comprising:

(1) a first planar sheet of metal reinforcing mesh (8) overlying one face of the perlite-based sheet, (2) a plurality of spaced, parallel, latticed beams (11) overlying the first mesh sheet, each beam comprising a plurality of elongate metal rods (7) disposed parallel to one another and interconnectd by skewed cross-members (12), and (3) a second planar sheet of metal reinforcing mesh (10) overlying the beams, and (c) a foamed plastic core (2) embedding the framework and binding the beams and mesh sheets together to establish three-dimensional rigidity without welding the beams to the mesh sheets.

2. A board as defined in claim 1, comprising a further planar sheet of perlite-based material (4) overlying the second mesh sheet to sandwich the framework and foamed core between perlite-based sheets.

3. A board as defined in claim 1, wherein each beam comprises three rods oriented such that, together with the interconnecting cross-members, they define a triangular prismatic configuration.

4. A board as defined in claim 2, wherein each beam comprises three rods oriented such that, together with the interconnecting cross-members, they define a triangular prismatic configuration.

* * * * *